US010791789B2

(12) United States Patent
Creak et al.

(10) Patent No.: US 10,791,789 B2
(45) Date of Patent: Oct. 6, 2020

(54) HELMET

(71) Applicant: Headkayse Ltd., Altrincham (GB)

(72) Inventors: Andy Creak, Danbury (GB); Tony Walker, Billericay (GB); Andrew Redman, Bath (GB); George Fox, Church Langton (GB)

(73) Assignee: Headkayse Ltd, Altrincham, Cheshire (GB)

( * ) Notice: Subject to any disclaimer, the term of this patent is extended or adjusted under 35 U.S.C. 154(b) by 1 day.

(21) Appl. No.: 15/741,622

(22) PCT Filed: Jul. 6, 2016

(86) PCT No.: PCT/GB2016/052030
§ 371 (c)(1),
(2) Date: Jan. 3, 2018

(87) PCT Pub. No.: WO2017/006111
PCT Pub. Date: Jan. 12, 2017

(65) Prior Publication Data

US 2018/0192730 A1 Jul. 12, 2018

(30) Foreign Application Priority Data

Jul. 7, 2015 (GB) ..... 1511901.9

(51) Int. Cl.
*A42B 3/32* (2006.01)
*A42B 3/12* (2006.01)
(Continued)

(52) U.S. Cl.
CPC ..... *A42B 3/322* (2013.01); *A42B 3/00* (2013.01); *A42B 3/066* (2013.01); *A42B 3/127* (2013.01);
(Continued)

(58) Field of Classification Search
CPC .. A42B 3/32; A42B 3/322; A42B 3/00; A42B 3/066; A42B 3/127; A42B 3/062;
(Continued)

(56) References Cited

U.S. PATENT DOCUMENTS 3,609,764 A * 10/1971 Morgan ..... A42B 3/122 2/414
3,668,704 A * 6/1972 Conroy ..... A42B 3/122 2/413
(Continued)

FOREIGN PATENT DOCUMENTS

CN 2067496 12/1990
EP 1034710 9/2000
(Continued)

OTHER PUBLICATIONS

Indiegogo Campaign (Excerpts), similar to but perhaps not identical with version first appearing online Oct. 2015.
(Continued)

*Primary Examiner* — Khaled Annis
*Assistant Examiner* — Dakota Marin
(74) *Attorney, Agent, or Firm* — John H. Runnels

(57) ABSTRACT

A helmet is described, more specifically a helmet comprising a protective shell (10) formed of a flexible expanded polyurethane (EPU) material which defines a cavity for receiving the wearer's head, the shell being foldable, the helmet further comprising a strap (11) arrangement for fastening the shell to the wearer's head.

12 Claims, 7 Drawing Sheets

(51) Int. Cl.

| | |
|---|---|
| ***A42B 3/00*** | (2006.01) |
| ***A42B 3/06*** | (2006.01) |
| *A42B 3/14* | (2006.01) |
| *A42B 1/20* | (2006.01) |
| *A42B 3/08* | (2006.01) |

(52) U.S. Cl.
CPC ..... *A42B 1/20* (2013.01); *A42B 1/201* (2013.01); *A42B 3/062* (2013.01); *A42B 3/063* (2013.01); *A42B 3/08* (2013.01); *A42B 3/128* (2013.01); *A42B 3/145* (2013.01); *A42B 3/32* (2013.01)

(58) Field of Classification Search
CPC ..... A42B 3/063; A42B 3/08; A42B 3/128; A42B 3/145; A42B 1/20; A42B 1/201
USPC ..... 2/414
See application file for complete search history.

(56) References Cited

U.S. PATENT DOCUMENTS

| | | | | | |
|---|---|---|---|---|---|
| 3,818,508 | A * | 6/1974 | Lammers | A42B 3/121 | 2/412 |
| 3,849,801 | A * | 11/1974 | Holt | A42B 3/121 | 2/413 |
| 3,882,547 | A * | 5/1975 | Morgan | A42B 3/121 | 2/414 |
| 4,001,894 | A * | 1/1977 | Roques-Rogery | A42B 3/105 | 2/15 |
| 4,443,891 | A * | 4/1984 | Blomgren | A42B 3/00 | 2/414 |
| 4,856,119 | A * | 8/1989 | Haberle | A42B 3/08 | 2/417 |
| 4,901,373 | A * | 2/1990 | Broersma | A42B 3/066 | 2/421 |
| 5,012,533 | A * | 5/1991 | Raffler | A42B 3/066 | 2/420 |
| 5,014,365 | A * | 5/1991 | Schulz | A42B 3/122 | 2/412 |
| 5,477,558 | A * | 12/1995 | Volker | A41D 13/0153 | 2/461 |
| RE35,193 | E | 4/1996 | Shifrin | | |
| 5,544,367 | A * | 8/1996 | March, II | A42B 3/00 | 2/410 |
| 5,551,094 | A * | 9/1996 | Navone | A42B 3/08 | 2/418 |
| 5,603,117 | A * | 2/1997 | Hudner, Jr. | A42B 3/127 | 2/423 |
| 6,266,827 | B1 | 7/2001 | Lampe | | |
| 6,349,416 | B1 * | 2/2002 | Lampe | A42B 3/00 | 2/411 |
| 6,367,090 | B1 | 4/2002 | Im | | |
| 6,442,765 | B1 * | 9/2002 | Fallon | A42B 3/066 | 2/410 |
| 6,854,133 | B2 * | 2/2005 | Lee | A42B 3/063 | 2/412 |
| 2006/0000009 | A1 | 1/2006 | Fleming | 2/412 | |
| 2009/0222976 | A1 * | 9/2009 | Loury | A42B 3/322 | 2/411 |
| 2011/0004980 | A1 * | 1/2011 | Leatt | A42B 3/0473 | 2/424 |
| 2013/0031700 | A1 * | 2/2013 | Wacter | A42B 3/322 | 2/411 |
| 2014/0075652 | A1 * | 3/2014 | Hanson | A42B 3/127 | 2/411 |
| 2016/0206034 | A1 * | 7/2016 | Degolier | A42B 3/127 | |
| 2018/0027915 | A1 * | 2/2018 | Cadens Ballarin | A42B 3/122 | |
| 2019/0116910 | A1 * | 4/2019 | Aharouni | A42B 3/328 | |

FOREIGN PATENT DOCUMENTS

| | | |
|---|---|---|
| FR | 2781650 | 2/2000 |
| FR | 2915852 | 11/2008 |
| GB | 2482866 | 2/2012 |
| WO | WO 1996/08176 | 3/1996 |
| WO | WO 2006/096941 | 9/2006 |
| WO | WO 2007/116427 | 10/2007 |

OTHER PUBLICATIONS

Guardian article Feb. 3, 2016, representative of other articles appearing in the press Nov. 2015-Feb. 2016.
International Preliminary Report.

* cited by examiner

HELMET

This is the United States national stage of international application PCT/GB2016/052030, international filing date Jul. 6, 2016, which claims the benefit of the Jul. 7, 2015 filing date of United Kingdom patent application serial number 1511901.9. The complete disclosure of the priority application is hereby incorporated by reference in its entirety.

This invention relates to a helmet and more particularly but not solely to a cycle helmet.

There is always the risk of sustaining a head impact whilst participating in sports and activities, such as cycling. Accordingly, the use of protective helmets is widespread to reduce the risk of serious brain injury or even death. Current understanding is that brain injuries in cycle accidents result from the high impact acceleration of the head making the soft brain material slump towards the impact. This creates damaging high pressure at the impact site, and crucially, causes high tearing tensions in the brain on the opposite side from the impact.

More recent research is showing even worse damage can be caused by sudden head rotation, which creates shear stresses and internal tearing around the outside of the brain as its mass catches up with the head rotation.

An unprotected head hitting a hard, immovable object, such as another vehicle or the ground, will be forced to change velocity within a couple of millimetres. Most cycle helmet standards assume that a survivable deceleration force is below 250 g and known helmets are designed such that the deceleration force in a 20 kph impact will be less than 250 g if the head can travel at least 6.27 mm as it decelerates. Hence, known cycle helmets are designed to do exactly this, by deforming more than 6.27 mm under the force of the head decelerating, they provide a cushion that allows the head to travel further and therefore experience lower decelerations.

In practice the deceleration is not linear because standard impact absorbing foams increase in resistance the more they are compacted. Most helmet materials therefore need to be around 25 mm thick to be able to absorb 12-15 mm of head movement before the head comes to a complete stop, to achieve a peak acceleration below 250 g.

Currently cycle helmets are formed of rigid materials, and usually comprise a liner of expanded polystyrene material and rigid shell of plastics material outside for durability and decoration. Expanded polystyrene is used for the liner because it is inexpensive, easy to mould and offers reasonable impact absorption over a wide temperature range.

A problem with this type of helmet is that they are awkward items to carry or store. This is a problem for commuters or business people travelling by bicycle as it is difficult to fit the helmet into any kind of normal day time work bag. Another problem is that it is difficult to make an expanded polystyrene helmet which comfortably fits a range of head shapes. This is mitigated with additional comfort pads or suspended internal adjustable straps.

A further problem is that whilst rigid, crushable liners of expanded polystyrene provide reasonable energy absorption and protection from straight on high speed impacts, the helmets are permanently crushed by an impact and can therefore only provide adequate protection for one impact. Such helmets are also too rigid to provide much absorption at lower speed impacts, which occur more frequently and can still cause brain injuries. Such helmets are also unable to absorb rotational accelerations from oblique impacts, now recognised as the more dangerous cause of serious brain injury.

A solution to these problems would be to make the helmet from a softer, more flexible material. However, the current cycle helmet safety standards, written to suit the strengths of expanded polystyrene, include the requirement to carry out drop tests of helmets at extreme temperatures of −20° C. to 50° C. This rules out many better alternatives, that nearly all fail the tests at the upper and lower temperature extremes.

With the above problems in mind, we have now devised an improved helmet.

In accordance with the present invention, as seen from a first aspect, there is provided a helmet comprising a protective shell formed of a flexible expanded polyurethane (EPU) material which defines a cavity for receiving the wearer's head, the shell being foldable, the helmet further comprising a strap arrangement for fastening the shell to the wearer's head; wherein said shell comprises a plurality of different layers of EPU material having different densities or different compositions, and wherein the helmet additionally comprises an outer polyurethane layer that is denser than said layers of EPU material; wherein said outer polyurethane layer is un-foamed, or comprises a smooth skin, or both; and wherein said outer polyurethane layer is harder and thinner than any of said layers of EPU material.

We have found that polyurethane is highly impact absorbent over a wide temperature range, whilst being softer than expanded polystyrene. The material is resiliently flexible to allow the helmet to be folded into or out of shape yet is able to withstand repeated impacts. When not in use, the helmet can be folded or compressed into a compact condition which enables the helmet to be easily carried, for example in a normal day time work bag.

Unlike expanded polystyrene, expanded polyurethane (EPU) material can withstand multiple impacts without significant loss of its impact absorbency. The helmet is thus ideal for children or sports persons, who are more likely to have numerous falls and accidents.

Expanded polyurethane (EPU) material, which is more flexible than expanded polystyrene, provides better low speed impact absorption than expanded polystyrene because it reduces accelerations which cause brain injuries.

An advantage of the helmet being flexible is that it can conform to shape and can move around the head more in an oblique impact, potentially reducing the dangerous rotational acceleration on the head.

The shell may be moulded from expanded polyurethane (EPU) material in a flat form, which can then be folded into shape to define the cavity for receiving the wearer's head.

The shell may comprise a plurality of different layers of expanded polyurethane (EPU) material having respective different densities or compositions to create improved impact protection. The outer layer of the shell may comprise an expanded polyurethane (EPU) material which is denser than the inner layer(s) or may be un-foamed or may comprise a smooth skin on the outside to provide a flexible but rugged outer layer for the shell. The inner layer(s) of the shell may comprise an expanded polyurethane (EPU) material which is softer and thicker than the outer layer to provide a more comfortable inner layer.

The shell may comprise one or more layers of non-expanded polyurethane (EPU) material. The shell may comprise an inner layer of a non-expanded polyurethane (EPU) material. The shell may comprise an outer layer of non-expanded polyurethane (EPU) material. The shell may comprise both inner and outer layers of non-expanded polyurethane (EPU) material. Additionally, it may be preferable for a layer of the shell comprising non-expanded polyurethane (EPU) material to be sandwiched between other layers of the shell, where these other layers may be expanded polyurethane (EPU), non-expanded polyurethane, or a combination of the two.

The external layer of the shell may comprise a weather proof material. Such a weather proof material is preferably water resistant or, more preferably, completely impermeable. It may also be preferable for the external layer of the shell to comprise anti-bacterial, anti-microbial or similar properties. It may be preferable for the inner layer of the shell to comprise anti-bacterial, anti-microbial or similar properties. It may be preferable for at least one layer of the shell to be treated with an anti-microbial treatment to obtain these properties.

Formations such as channels, cut outs or indents may be formed in the inner surface of the shell to provide fold lines to enable the shell to be folded into a curved shaped by folding in certain directions in order to create the desired folded shape.

The shell may comprise a reinforcing material such as a woven polymer, glass, Kevlar or carbon fibre fabric. The material may be provided as a layer over the entire shell or as one or more discrete regions.

The shell may comprise a plurality of fingers extending radially from a locus. In use the distal ends of the fingers are brought together to form a curved shell which defines the cavity for receiving the wearer's head. The locus of the fingers may form the front of the helmet and a peak may be provided at the front of the helmet.

It may be preferable for at least one finger to contain at least one aperture, allowing the passage of air through the finger to provide ventilation to the user.

The shell may comprise a central finger and pair of side fingers extending symmetrically on respective opposite sides of the central finger. In use, the central finger extends over the top of the wearer's head and the side fingers extend around respective sides of the head.

The shell may comprise a pair of middle fingers extending symmetrically on respective opposite sides of the central finger between the latter and the respective side fingers.

The side fingers may be longer than the middle fingers, the side fingers forming the rim 220 of the shell. The middle fingers are shorter than the central finger.

The distal ends of the side fingers may be detachably interconnected by a strap, for example comprising a hook-and-pile type fastening. The strap enables the diameter of the shell to be adjusted to fit a wide range of head sizes. The strap may also engage the central finger. The strap may also comprise a ratchet mechanism. Any ratchet mechanism may be used as the sole means of adjusting the shell diameter, or in combination with a hook-and-pile type fastening, or in combination with another type of fastener.

The distal end of central finger may comprise a pair of wings which extend laterally in respective opposite directions, the thickness of the wings tapering inwardly towards their outer ends to form wedges, the distal ends of the side fingers being correspondingly tapered. In this way when the side fingers are pulled together by the strap, the tapering forces the distal end of the central finger further forward, reducing the effective size of the helmet.

The strap arrangement (depicted as 240) may engage the middle and/or side fingers to hold them in-situ. The strap arrangement (depicted as 240) may comprise a side strap portion and/or a chin strap portion which passes through passageways in the fingers to hold them in-situ. Alternatively, the side strap portion and/or the chin strap portion may pass over the middle finger.

The strap arrangement (depicted as 240) may engage the central finger to hold it in-situ. The strap arrangement may comprise a top strap portion which passes over or through the central finger to bias the central finger downwardly.

The strap arrangement may comprise a chin strap which, in use, passes under the wearer's chin and a head strap which, in use, passes over and behind the wearer's head, preferably through said passageways.

The head strap may comprise first and second head strap members having a first end secured to the shell at a respective side thereof, the straps extending upwardly and converging towards a first point (230) at the central finger where they cross over each other, the straps then extending downwardly, rearwardly and inwardly to a point which, in use, is located behind the wearer's head where the straps cross, the second ends of the strap members being secured to respective sides of the chin strap.

The straps cross over each other behind the wearer's head under the wearer's occipital lobe, where they may pass through a former which defines passageways that cross over and hold the strap members in an X-shaped formation and provide greater comfort.

The strap arrangement securely holds the shell in situ and prevents it from slumping forwardly or rearwardly in the event of an accident.

The second ends of the strap members may be adjustably secured to respective sides of the chin strap of the assembly, and is preferably secured to the chin strap at a point which, in use, is located under the wearer's ears.

The first ends of the first and second head strap members may be secured to the respective side fingers of the shell at a point which, in use, is preferably located over or behind the wearer's ears.

The first and second strap members may provide said side strap portions which engage the middle fingers to hold them in-situ.

The first and second strap members may provide said top strap portion at said first point (230) where they cross over.

It will be appreciated that the strap arrangement also has utility with other kinds of helmets in addition to the helmet of the present invention. Thus, in accordance with the present invention, as seen from a second aspect, there is provided a helmet comprising a protective shell and a strap arrangement for fastening the shell to the wearer's head, the strap arrangement including a head strap comprising first and second head strap members having a first end secured to the shell at a respective side thereof, the straps extending upwardly and converging towards the central of the shell where they cross over each other, the straps then extending downwardly, rearwardly and inwardly to a point which, in use, is located behind the wearer's head where the straps cross, the second ends of the strap members being secured to respective sides of a chin strap of the assembly.

The second ends of the strap members may be adjustably secured to respective sides of a chin strap of the assembly.

The first and second strap members cross over each other behind the wearer's head under the wearer's occipital lobe, where they may pass through an X-shaped retainer to support the straps and to provide greater comfort.

An embodiment of the present invention will now be described by way of an example only and with reference to the accompanying drawings, in which.

Figure 1:
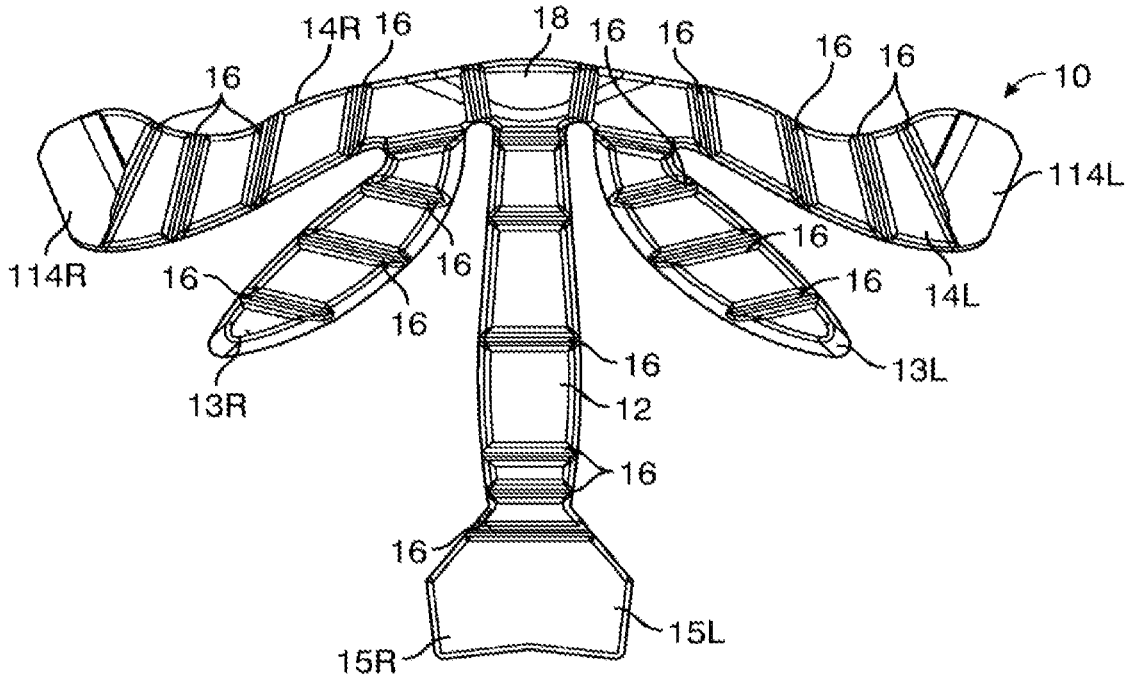
FIG. 1 is a bottom view of the shell of a foldable cycle helmet in accordance with the present invention, when in its unfolded and as-moulded configuration.
Figure 2:
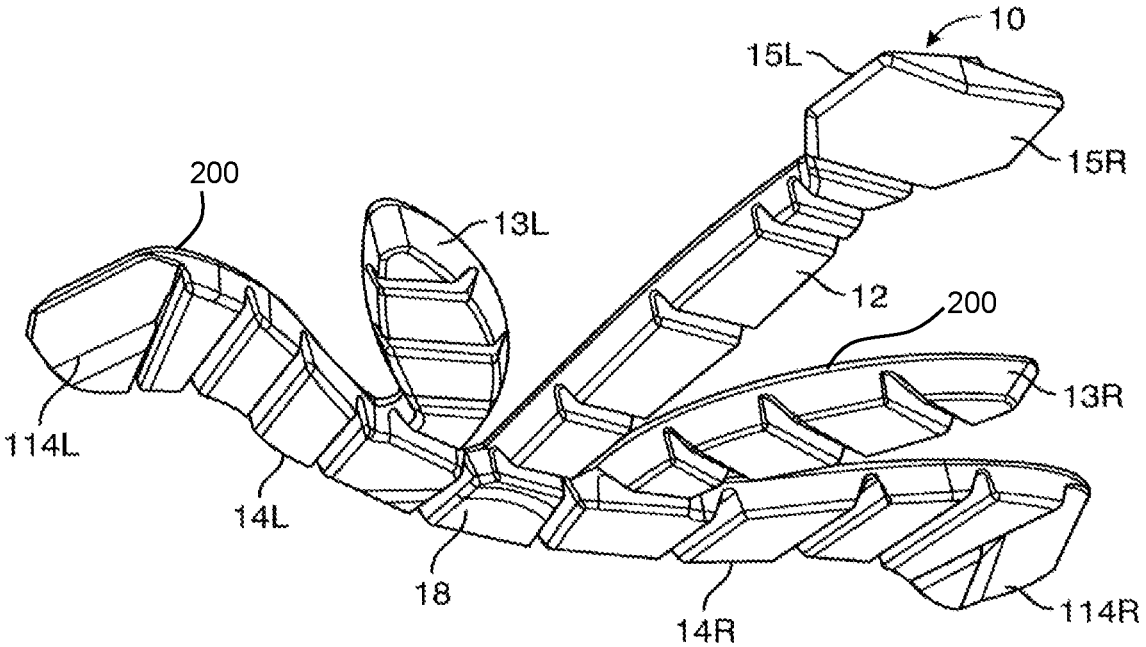
FIG. 2 is perspective view from below and the rear of the shell of the helmet of FIG. 1.
Figure 3:
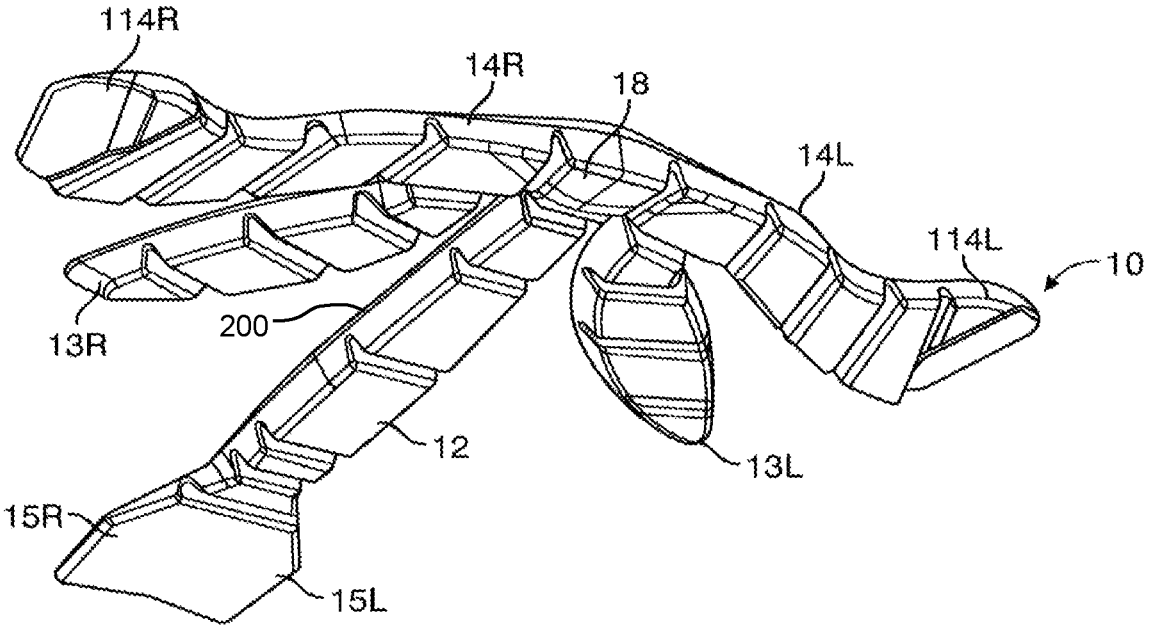
FIG. 3 is perspective view from below and the front of the shell of the helmet of FIG. 1.
Figure 4:
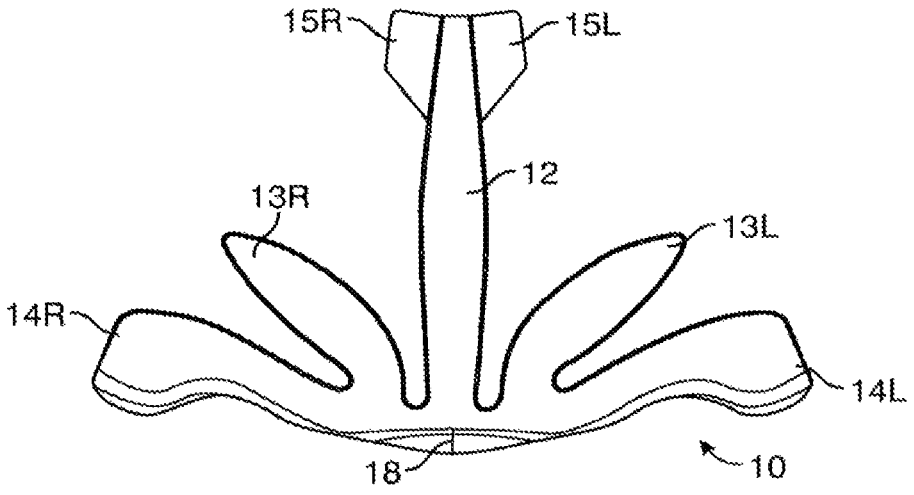
FIG. 4 is a top view of the shell of the helmet of FIG. 1.
Figure 5:
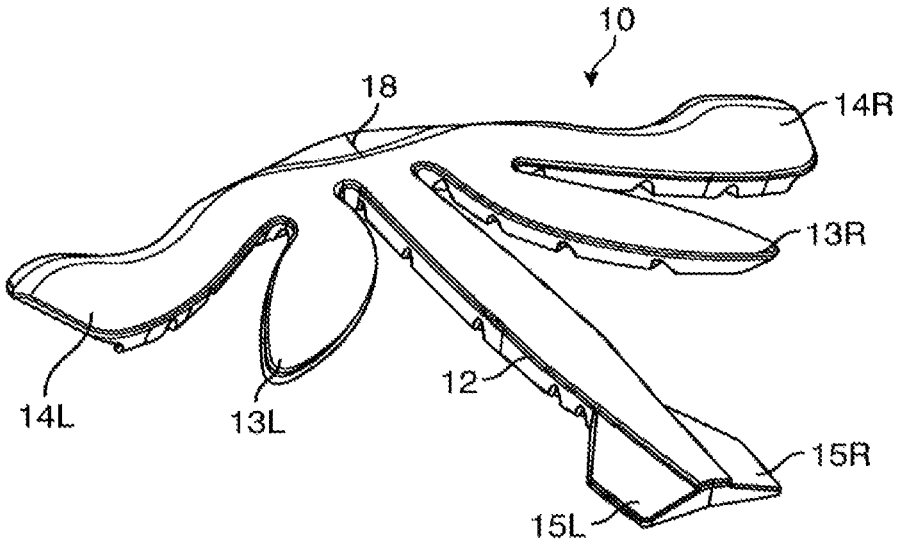
FIG. 5 is perspective view from above and the rear of the shell of the helmet of FIG. 1.
Figure 6:
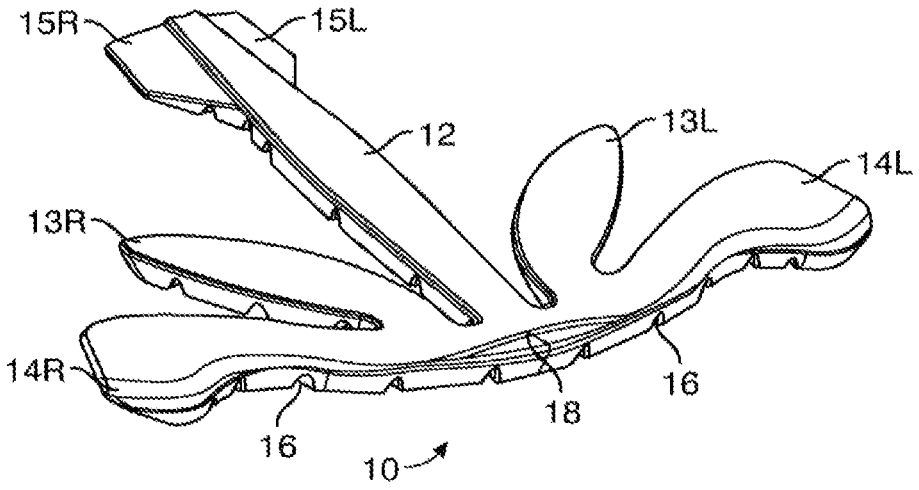
FIG. 6 is perspective view from above and the front of the shell of the helmet of FIG. 1.

Referring to the drawings there is shown a foldable cycle helmet comprising a shell 10 and strap arrangement 11. The shell 10 is formed of expanded polyurethane (EPU) material, for example by moulding. The shell 10 is preferably formed in a flat (unfolded) condition and may comprise a plurality of different layers (not shown) of expanded polyurethane (EPU) material having respective different densities or compositions. The outer layer 200 of the shell 10 may comprise an expanded polyurethane (EPU) material which is denser than the inner layer(s) or may be un-foamed or may comprise a smooth skin on the outside to provide a flexible but rugged outer layer 200 for the shell 10. The inner layer(s) of the shell 10 may comprise an expanded polyurethane (EPU) material which is softer and thicker than the outer layer 200 to provide a more comfortable inner layer.

The shell 10 comprises a plurality of fingers extending radially from a locus 18. The fingers 13L, 13R, 14L, 14R are symmetrical about a central finger 12 and comprise a pair of middle fingers 13L, 13R extending symmetrically on respective opposite sides of the central finger 12 between the latter and respective side fingers 14L, 14R. The side fingers 14L, 14R are longer than the middle fingers 13L, 13R. The middle fingers 13L, 13R are shorter than the central finger 12.

The distal end of central finger 12 comprises a pair of wings 15L, 15R which extend laterally in respective opposite directions, the thickness of the wings 15L, 15R tapering inwardly towards their outer ends to form outwardly facing wedges, the distal ends of the side fingers 14L, 14R are correspondingly tapered to form inwardly facing wedges 114L, 114R.

Figure 7:
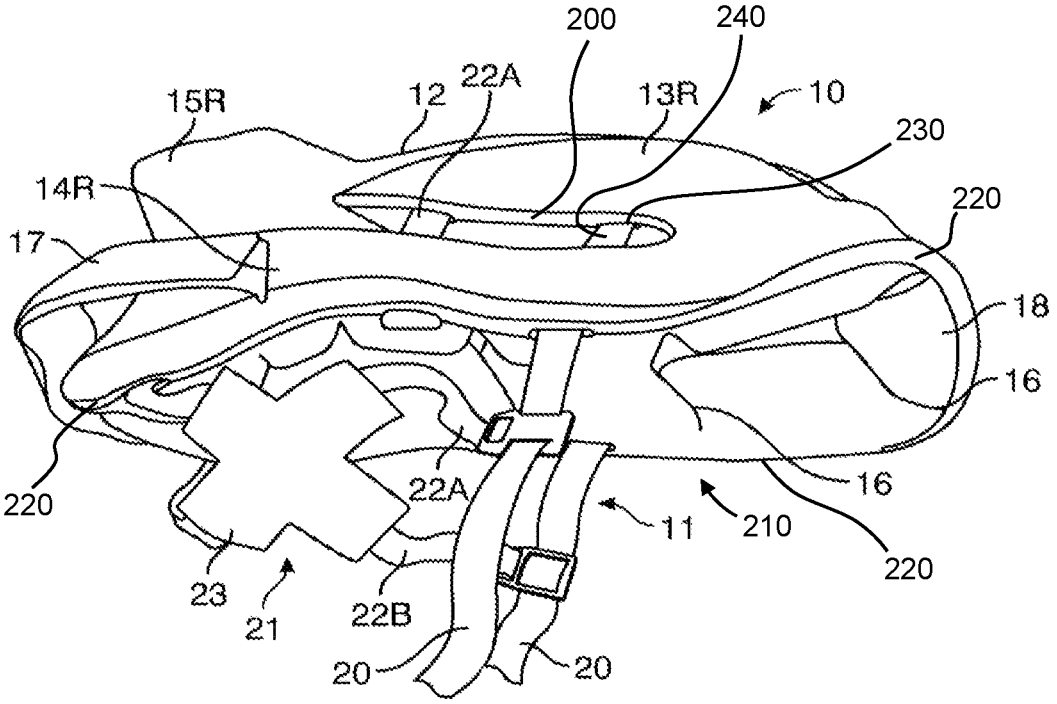
FIG. 7 is perspective view from below and the right side of the helmet of FIG. 1, when in its folded condition.
Figure 8:
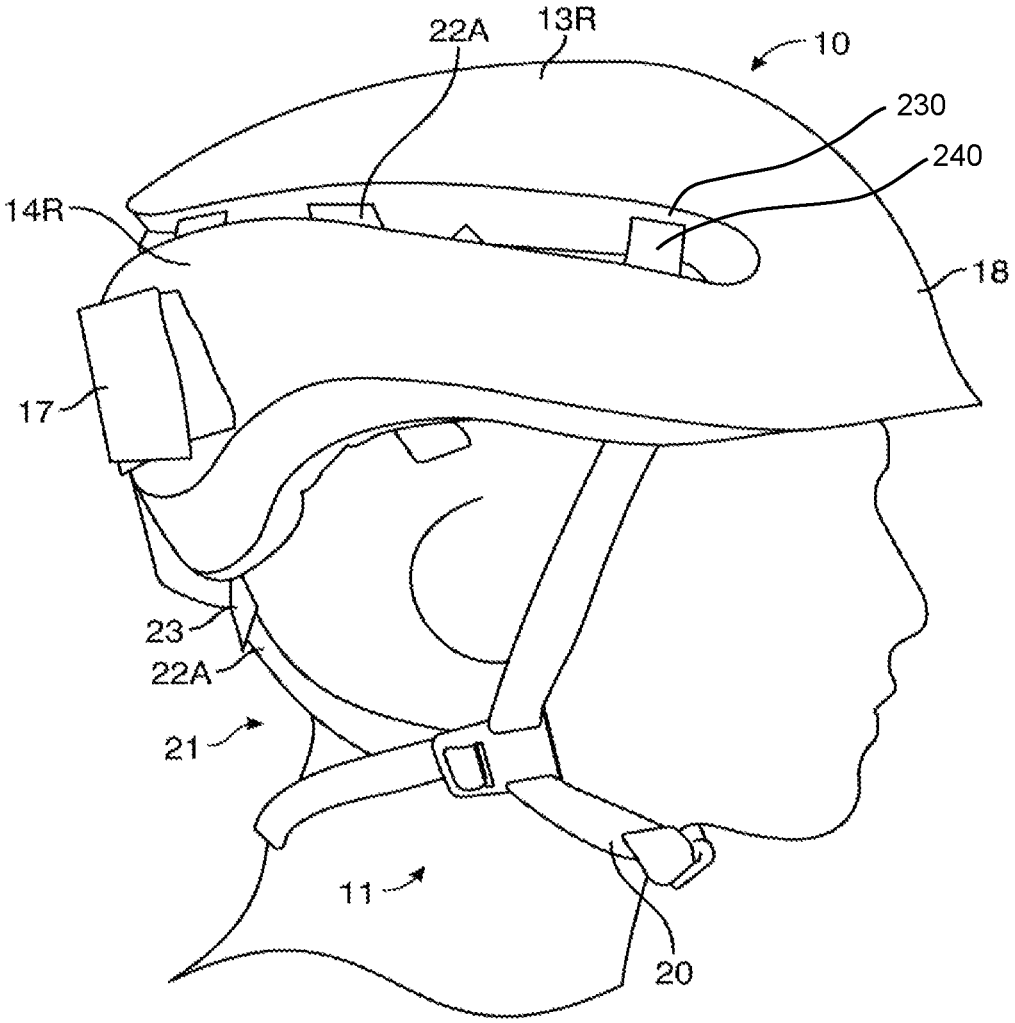
FIG. 8 is a right side view of the helmet of FIG. 1, when in use.
Figure 9:
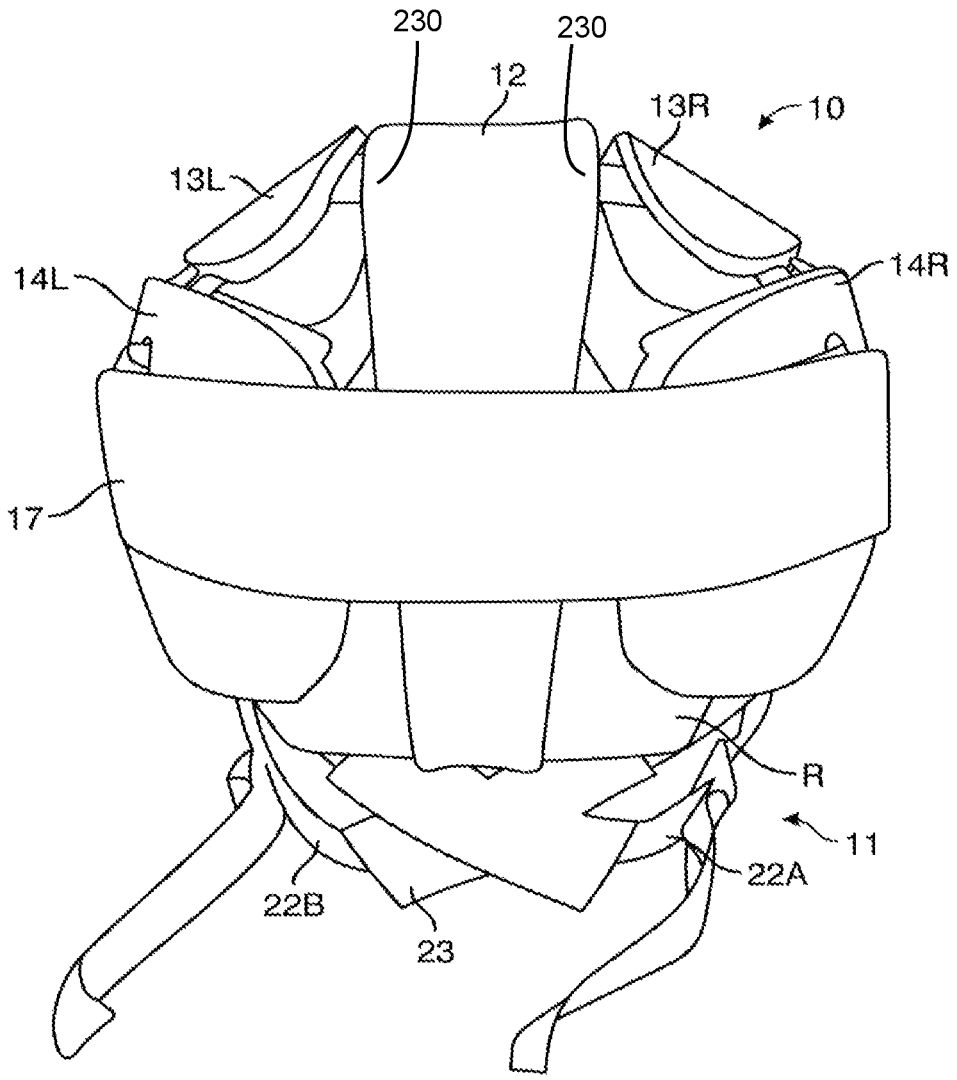
FIG. 9 is a rear view of the helmet of FIG. 1, when in use.
Figure 10:
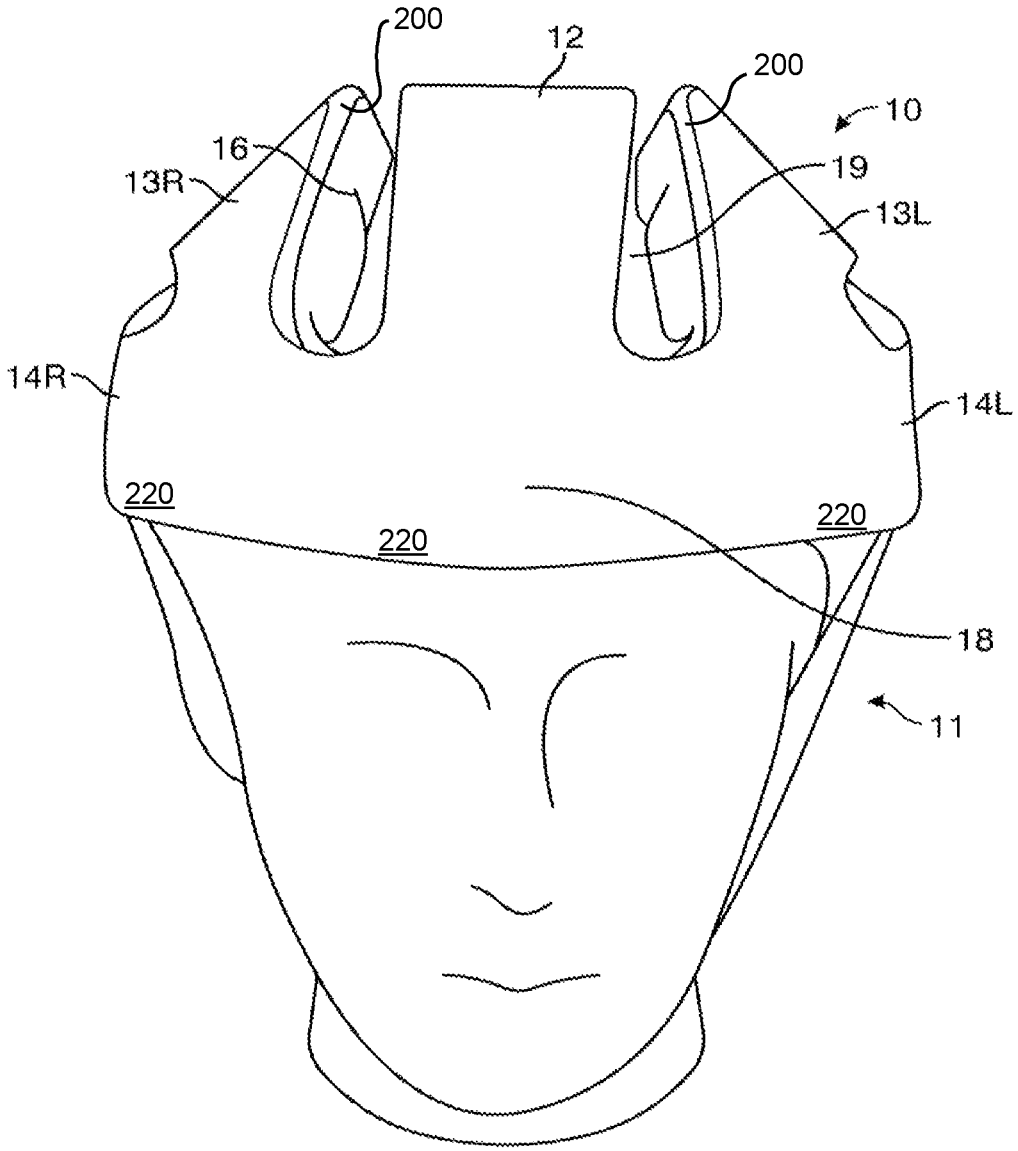
FIG. 10 is a front view of the helmet of FIG. 1, when in use.

V-shaped channels 16 are formed in the inner surface of the shell 10 to provide fold lines to enable the shell 10 to be folded into a curved shape by folding the distal ends of the fingers 12, 13L, 13R, 14L, 14R together to form a curved shell 10 which defines a cavity 16 for receiving the wearer's head (depicted as 210 in FIG. 7). The distal ends of the side fingers 14L, 14R are detachably interconnected by a strap 17, for example comprising a hook-and-pile type fastening. The strap 17 enables the diameter of the shell 10 to be adjusted to fit a wide range of head sizes. When the side fingers 14L, 14R are pulled together by the strap 17, their tapered ends slide over the tapered wings 15L, 15R to force the distal end of the central finger 12 further forward, reducing the effective size of the helmet.

The locus 18 of the fingers form the front of the helmet, which may be provided with a peak (not shown). The strap 17 is disposed at the rear of the helmet.

The strap arrangement 11 comprises an adjustable chin strap 20 which, in use, passes under the wearer's chin and a head strap 21 which, in use, passes over and behind the wearer's head. The head strap 21 comprises first and second head strap members 22A, 22B each having a first end secured to respective side fingers 14L, 14R of the shell 10 at a point which, in use, is located over and behind the wearer's ears. The strap members 22A, 22B then extend upwardly and freely through respective channels formed in the distal ends of the middle fingers 13L, 13R to hold the middle fingers 13L, 13R in-situ. The strap members 22A, 22B then converge towards a point over the central finger 12 where they cross over each other, the strap members 22A, 22B then extending downwardly, rearwardly and inwardly to a point which, in use, is located behind the wearer's head where the strap members 22A, 22B cross. An X-shaped retainer 23 supports the strap members 22A, 22B where they cross and provides greater comfort. The second ends of the strap members 22A, 22B are then adjustably secured to respective sides of the chin strap 20.

The strap arrangement 11 securely holds the shell 10 in-situ on the wearer's head and prevents it from slumping forwardly or rearwardly in the event of an accident.

As shown in FIG. 7, when not in use, the rear strap 17 can be loosened to allow the fingers to fold apart into a substantially flat condition, so that the helmet can easily be transported and stored.

A helmet in accordance with the present invention is simple and inexpensive in construction yet is foldable and is able to withstand repeated impacts.

The invention claimed is:

1. A helmet comprising a protective shell which defines a cavity for receiving a wearer's head, wherein said shell is foldable, and wherein said helmet further comprises a strap arrangement for fastening said shell to the wearer's head;

(a) wherein said shell comprises a flexible expanded polyurethane (EPU) material;

(b) wherein the helmet additionally comprises an outer layer that is denser than said EPU material; wherein said outer layer is un-foamed, or comprises a smooth skin, or both;

(c) wherein said outer layer is harder and thinner than said EPU material;

(d) wherein said shell comprises a plurality of fingers extending radially from a locus: a central finger, a pair of side fingers extending symmetrically on opposite sides of said central finger, and a pair of middle fingers extending symmetrically on opposite sides of said central finger, one of said middle fingers located between said central finger and each of said side fingers; wherein each of said fingers has a distal end; wherein the distal end of said central finger comprises a pair of wings which extend laterally in opposite directions; wherein each of said wings has a thickness and each of said wings has a distal end; wherein the thickness of each of said wings tapers inwardly toward the distal end to form a wedge; wherein the plurality of distal ends of said side fingers are correspondingly tapered; and wherein the distal ends of the fingers are arranged to be brought together to form said shell and to form the cavity for receiving the wearer's head;

(e) wherein said helmet is resiliently flexible to allow said fingers to be folded, so that the helmet assumes a more compact shape when not in use, for transportation or storage; and (f) wherein said helmet can withstand multiple high-speed impacts without significant loss of impact absorbency over the temperature range −20° C. to 50° C.; impacts that would be sufficient to permanently crush a conventional expanded polystyrene helmet; wherein said helmet can be safely re-used following multiple such high-speed impacts, under conditions where a conventional expanded polystyrene helmet would not be safe to reuse following even one such high-speed impact.

2. A helmet as claimed in claim 1, wherein an inner surface of said shell comprises fold lines to assist said shell to be folded;

wherein the inner surface of said shell is defined as the surface of said shell adapted to be located adjacent to the wearer's head.

3. A helmet as claimed in claim 1, wherein said EPU material is a composite material comprising a reinforcing material and expanded polyurethane.

4. A helmet as claimed in claim 1, wherein said side fingers are longer than said middle fingers, and wherein said side fingers are arranged to form a rim of said shell.

5. A helmet as claimed in claim 1, wherein said middle fingers are shorter than said central finger.

6. A helmet as claimed in claim 1, wherein e plurality of said distal ends of said side fingers are detachably interconnected by a strap.

7. A helmet as claimed in claim 1, wherein said strap arrangement engages said middle fingers to hold said middle fingers in-situ, and to inhibit said shell from slumping forwardly or rearwardly on the wearer's head in the event of an accident.

8. A helmet as claimed in claim 1, wherein said strap arrangement comprises one or more elements selected from the group consisting of: (a) a side strap portion which passes over or through said middle fingers; (b) an element that engages said central finger to hold said central finger in-situ, and to inhibit said shell from slumping forwardly or rearwardly on the wearer's head in the event of an accident; (c) a top strap portion which passes over or through said central finger to bias said central finger downwardly; (d) a chin strap which, in use, passes under the wearer's chin, and a head strap which, in use, passes over and behind the wearer's head, wherein said head strap comprises first and second head strap members, wherein each of said head strap members has a first end secured to a side of said shell, and wherein each of said head strap members extends upwardly and converges towards a first point on said central finger where said first and second head strap members cross over each other, and wherein said head strap members then extend downwardly, rearwardly, and inwardly to a second point which, in use, is located behind the wearer's head, where said first and second head strap members cross, and wherein each of said first and second head strap members has a second end secured to said chin strap.

9. A helmet as claimed in claim 1, wherein said helmet additionally comprises: (a) a side strap portion which passes over or through said middle fingers; (b) an element that engages said central finger to hold said central finger in-situ, and to inhibit said shell from slumping forwardly or rearwardly on the wearer's head in the event of an accident; (c) a top strap portion which passes over or through said central finger to bias said central finger downwardly; (d) a chin strap which, in use, passes under the wearer's chin, and a head strap which, in use, passes over and behind the wearer's head, wherein said head strap comprises first and second head strap members, wherein each of said head strap members has a first end secured to a side of said shell, and wherein each of said head strap members extends upwardly and converges towards a first point on said central finger where said first and second head strap members cross over each other, and wherein said head strap members then extend downwardly, rearwardly, and inwardly to a second point which, in use, is located behind the wearer's head, where said first and second head strap members cross, and wherein each of said first and second head strap members has a second end secured to said chin strap.

10. A helmet as claimed in claim 9, wherein said strap members pass through an X-shaped retainer at the point where said strap members cross behind the wearer's head, and wherein second ends of said strap members are adjustably secured to sides of said chin strap.

11. A helmet as claimed in claim 10, wherein the first ends of said first and second head strap members are each secured to one of said side fingers.

12. A helmet as claimed in claim 1, wherein said shell comprises a plurality of different layers of expanded polyurethane material having different densities or different compositions.

* * * * *